United States Patent [19]

Martin

[11] 4,155,674

[45] May 22, 1979

[54] OFFSHORE PLATFORMS

[75] Inventor: Yves Martin, Paris, France

[73] Assignee: Compagnie Francaise d'Entreprises Metalliques, Paris, France

[21] Appl. No.: 822,880

[22] Filed: Aug. 8, 1977

[30] Foreign Application Priority Data

Aug. 17, 1976 [FR] France ..... 76 24967

[51] Int. Cl.[2] ..... E02D 5/74; E02D 27/52

[52] U.S. Cl. ..... 405/224; 405/253

[58] Field of Search ..... 61/98, 99, 4, 34, 94; 405/253

[56] References Cited

U.S. PATENT DOCUMENTS

| | | | |
|---|---|---|---|
| 1,847,814 | 3/1932 | Byrne | 61/34 X |
| 2,938,353 | 5/1960 | Vorenkamp | 61/99 |
| 3,393,520 | 7/1968 | Butterworth | 61/4 |
| 3,999,395 | 12/1976 | Broms et al. | 61/99 |

FOREIGN PATENT DOCUMENTS

| | | | |
|---|---|---|---|
| 1121256 | 7/1968 | United Kingdom | 61/99 |

*Primary Examiner*—Mervin Stein
*Assistant Examiner*—David H. Corbin
*Attorney, Agent, or Firm*—Larson, Taylor and Hinds

[57] ABSTRACT

An offshore platform of the weighted base kind has a castellated contour at the base of the skirts, the shape of the contour being such as to produce, at the first impact with the ground, a contact line appreciably shorter than the average length of the contour.

4 Claims, 6 Drawing Figures

OFFSHORE PLATFORMS

FIELD OF INVENTION

The invention relates to offshore platforms, inter alia for oil installations, of the weighted base kind—that is of the kind having at the bottom of the platform support structure a base which, when the platform is positioned, embeds itself in the seabed as a result of being ballasted down appropriately with ballast, such as seawater or sand or any other substances. An offshore platform of this kind accordingly has a penetrating base having skirts or spade-like members adapted to take up substantially vertical directions for engaging the ground.

BACKGROUND OF INVENTION

The penetration resistance of the spade-like members, which can be broken down into a front or tip resistance and a lateral sliding resistance, varies with the nature of the layers of ground passed through, particularly according to whether the layers have a sand or clay base.

This is the reason for the disadvantages inherent in the prior art solution of the problem, which is for the spade-like members to have a continuous horizontal edge, for, to an extent depending upon the nature of the ground penetrated, it does not always prove possible for the spade-like members to penetrate stably and fully. There is a risk of partial penetration with voids below the base or else an excessive weight of ballast may have to be used.

It has been suggested that the spade-like members should have minor undulations, but the result is unsatisfactory.

SUMMARY OF THE INVENTION

According to the invention, to improve penetration, the contour of the bottom edge of the spade-like members has a castellated or wavy pattern such as to provide upon the first impact with the ground a contact line appreciably shorter than the average length of the contour, more particularly a shape having rectangular undulations.

In addition to this main feature the invention comprises other features which are preferably used simultaneously and which include:

the provision in combination with the spade-like members of transverse stiffeners, particularly in the region of the castellations hereinbefore defined, and the thickness of the plates or walls of the spade-like members decreasing upwardly, thus reducing the lateral sliding resistance as the spade-like member penetrates deeper into the ground.

The invention relates more particularly to a particular use—offshore platforms for oil installations—and to particular embodiments of the features hereinbefore outlined, and relates still more particularly, as new industrial products, to platforms of the kind concerned in which the features according to the invention are used and to the special elements for the devising of the features and to installations comprising the same.

PARTICULAR DESCRIPTION OF THE INVENTION

Figure 1:
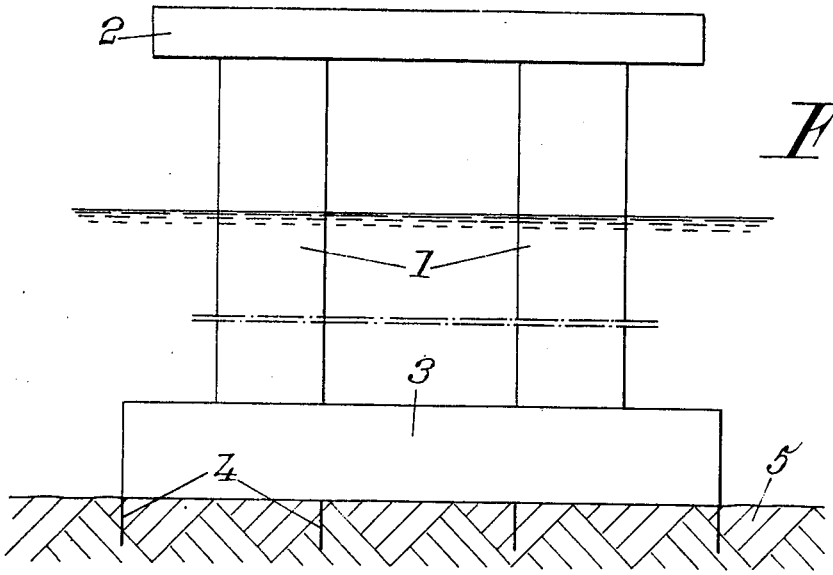
Figure 2:
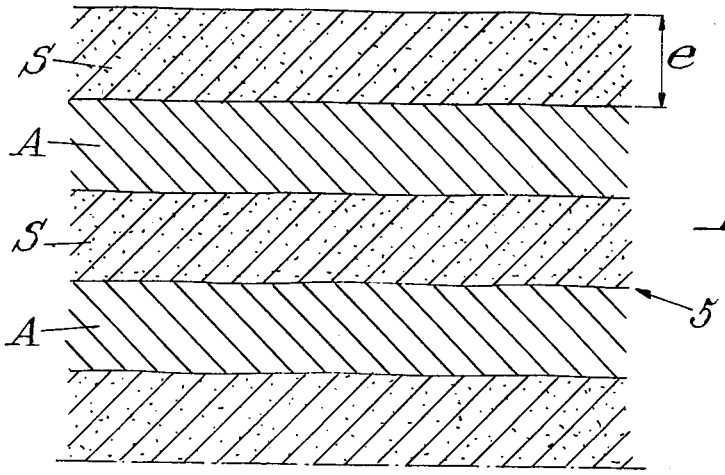
Figure 3:
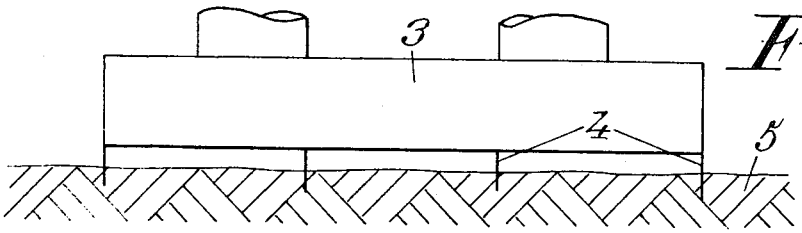
Figure 4:
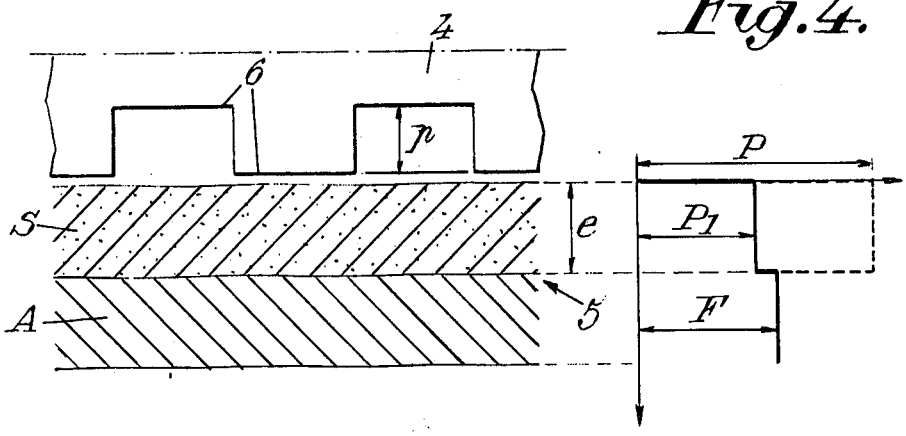
Figure 5:
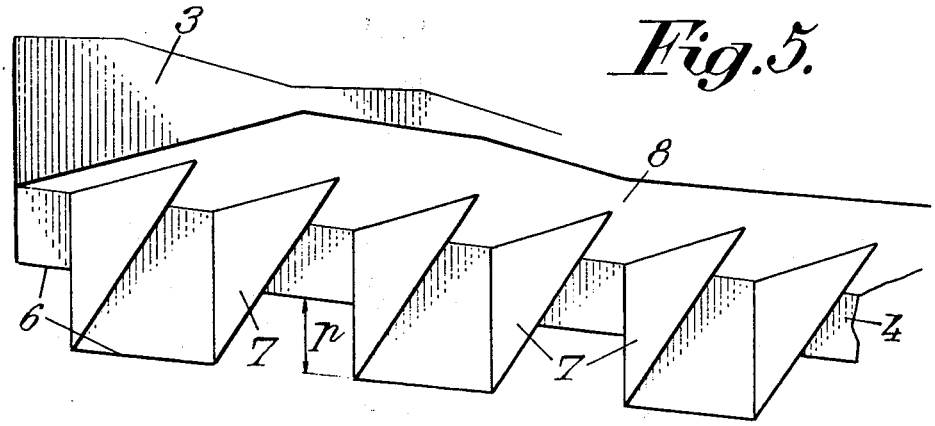
Figure 6:
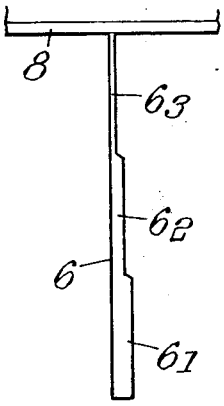

For a better understanding of the present invention and to show how the same may be put into effect, reference will now be made, by way of example, to the accompanying drawings, in which:

FIG. 1 shows a diagrammatic partial elevational view of a weighted base kind offshore platform which is in an anchorage position on the seabed and whose spade-like members at the base have the special means according to the invention, FIG. 2 shows a section to an enlarged scale through a seabed showing layers of different kinds, for example layers of sand and of clay, FIG. 3 shows a view similar to FIG. 1 of a platform whose base has penetrated the seabed unsatisfactorily, something which it is an object of the invention to obviate, FIG. 4 shows a partly diagrammatic elevational view of a base having a spade-like member according to the invention, the base being disposed opposite the seabed comprising a number of stratified layers, for example of sand and clay, the Figure also including a diagram illustrating resistances to penetration of the base into the seabed, FIG. 5 shows a perspective view of a portion of a base having a spade-like member according to the invention, and FIG. 6 shows a vertical sectional view of a spade-like or digging member comprising other features of the invention.

According to the invention, more particularly according to that of its uses and those embodiments of its different parts which seem preferable, there being available a weighted base type platform—that is a platform having a structure 1 (see FIG. 1) carrying a top bridge or platform 2 and having at the for example rectangular bottom part a tank-like base 3 adapted to be ballasted as required and, if necessary, perform any other duty—and if it is proposed to devise such a base with spade-like or digging members 4 for penetrating into a seabed 5, more particularly a stratified seabed, the following or a similar procedure is followed.

A platform of this kind is of course brought to the flotation site, then mounted on the seabed 5 by means of appropriate ballasting.

The problem is to ensure that the members 4 penetrate completely solely as a result of the ballasting step, for the amount of ballast to be placed in the platform is limited and must always be sufficient to overcome the seabed reaction against penetration of the members 4. Incomplete penetration of the kind shown in FIG. 3 is hazardous because of the instability of the platform. The only way of improving the situation is to increase the ballast, with the result that operations are prolonged and extra expenditure is incurred, and the expenditure increases very rapidly in the case of platforms in very deep seabeds of for example 100 meters depth where the size of the bases themselves may be as much as the side of from 50 to 100 meters.

To obviate these difficulties—which occur more particularly in the common case shown in FIG. 2 where there is a laminated seabed comprising a number of alternate sand layers S and clay layers A having a thickness e of the order of from 1 to 2 meters or more—the Inventor has started from the experimental fact that the resistance to penetration of the digging members consists of the following components:

(a) a front or "tip" resistance $R_p$ along the bottom edge of the walls of the digging members, and (b) a rubbing or sliding resistance $R_f$ along the walls of the members 4.

These two components differ very considerably in dependence upon the nature of the layers of the seabed 5.

The component $R_p$ predominates in the case of sand layers but is low in the case of clay layers. Clearly, therefore, it is advantageous to try and reduce the component $R_p$ when it is required to penetrate a sand layer S, a feature all the more important in that the first layer passed through is, as shown in FIG. 4, often a sand layer.

According to the invention, therefore, the bottom edge of the digging or spade-like members 4 has a wavy or undulating shape so that each such member 4 has, when it impacts the layer as S, a contact length less than the average length of the corresponding wavy line.

Assuming, for instance, that rectangular castellations of the kind 6 shown in FIGS. 4 and 5 are provided whose depth p is, for instance, of the same order of magnitude as the thickness e of the sand layer under consideration, the peak resistance $P_1$ when the member 4 contacts the sand is half the resistance P which would have arisen in the absence of castellations.

Since this peak resistance can be overcome more readily—that is, by less ballasting—the member 4 passes through the sand layer S in optimum conditions until it reaches the next clay layer A, in which there is lateral friction F, and so on. For the sake of simplicity only two layers S and A have been shown in FIG. 4.

Penetration by the members 4 is therefore improved.

The rectangular undulations are of course given only as examples and the undulations can be of any other shape, such as rounded, pointed and so on.

The features described in the foregoing are of course applicable equally well to metal bases and to concrete-wall type bases.

Advantageously and if necessary, the projecting parts of the undulations are strengthened by any means such as gussets 7 (see FIG. 5) which bear on bottom 8 of base 3 or any corresponding element.

It may also be advantageous if the thickness of the corresponding parts 6 of the members 4 decreases upwardly so as to reduce the frictional resistance of the layers passed through, having regard to the fact that the ground does not close completely on the digging member in penetration.

FIG. 6 shows three consecutive thicknesses $6_1$, $6_2$ and $6_3$ of part 6 of bottom 8. This feature provides further improvement in penetration.

Consequently, whichever embodiment is used, offshore platform bases can be provided whose digging or spade-like members or other constituent elements have been sufficiently described above to make any further description unnecessary, the bases according to the invention providing better penetration into the ground and thus giving various advantages over known constructions, including:

speeding up the operations of anchoring the platform to the seabed;

reducing ballasting weight, and consequently reducing the first cost of the installation.

Clearly, and as the foregoing shows, the invention is not limited to those of its uses and embodiments which have been more particularly considered but covers all the variants, as will be appreciated by an expert in the art.

I claim:

1. In a weighted base offshore platform which comprises a weighted base having a bottom member, an upstanding support structure extending upwardly of said weighted base a distance sufficient to extend above the surface of the sea in which the platform is to be located, a platform mounted on top of said support structure above the sea surface, said weighted base including a generally planar and elongate spade member extending downwardly from said bottom member of the weighted base for penetrating into the sea bed, the improvement wherein the lower edge of said spade member has an undulating contour formed by substantially rectangular castellations and indentations therein which extend less than the full height of said spade member such that, upon first contacting the sea bed, a contact line formed by the lower edges of said castellations and appreciably shorter than the average length of said lower edge contacts the sea bed whereby full penetration of said spade member into the sea bed is facilitated, and wherein said castellations of said spade member are provided with transverse stiffeners bearing on said bottom member.

2. An improved platform according to claim 1 wherein said indentations are rectangular.

3. An improved platform according to claim 1 wherein the depth of the indentations is substantially the same as the thickness of a layer of sand on the sea bed in which the platform is to be embedded.

4. An improved platform according to claim 1 wherein the spade member decreases upwardly in thickness.

* * * * *